United States Patent [19]

Takahashi

[11] 4,167,849

[45] Sep. 18, 1979

[54] WATCH WITH ELECTRONIC BUZZER

[75] Inventor: Keikichi Takahashi, Tokyo, Japan

[73] Assignee: Kabushiki Kaisha Daini Seikosha, Japan

[21] Appl. No.: 852,548

[22] Filed: Nov. 17, 1977

[30] Foreign Application Priority Data

Nov. 19, 1976 [JP] Japan ..... 51-139846

[51] Int. Cl.[2] ..... G04B 23/12

[52] U.S. Cl. ..... 58/57.5; 58/90 R; 340/384 E

[58] Field of Search ..... 58/16, 23 R, 57.5, 90 R; 340/384 R, 384 E

[56] References Cited

U.S. PATENT DOCUMENTS 3,577,876 5/1971 Spadini ..... 58/57.5

3,858,389 1/1975 Isuruishi ..... 58/57.5

3,863,437 2/1975 Barth et al. ..... 58/57.5

*Primary Examiner*—Ulysses Weldon

*Attorney, Agent, or Firm*—Robert E. Burns; Emmanuel J. Lobato; Bruce L. Adams

[57] ABSTRACT

A waterproof acoustic vibrator for a timepiece and comprising a waterproof housing and a plate-like member having a magnetic portion. The plate-like member is mounted for oscillation opposite the waterproof housing and is maintained in a rest position by first magnetic biasing structure. Second magnetic biasing structure magnetically biases the plate-like member to oscillate and develop audible acoustic waves. The first magnetic biasing structure is a permanent magnet, and the second magnetic biasing structure is an electromagnet disposed within the waterproof housing.

6 Claims, 2 Drawing Figures

WATCH WITH ELECTRONIC BUZZER

BACKGROUND OF THE INVENTION

The present invention relates to a watch and more particularly to a water-proof construction of a watch having an electronic buzzer or acoustic vibrator.

SUMMARY OF THE INVENTION

In a timepiece, a waterproof acoustic vibrator comprising a waterproof housing and a plate-like member having a magnetic portion and mounted for oscillation opposite the waterproof housing. First magnetic biasing means magnetically biases the plate-like member to maintain the same in a rest position when the plate-like member is not oscillating. Second magnetic biasing means within the waterproof housing magnetically biases the plate-like member to oscillate and develop audible acoustic waves. The waterproof housing includes a side made of non-conductive material, and that side includes a shoulder portion raised above the side and dimensioned for supporting the plate-like member with a peripheral portion of the plate-like member resting on the shoulder portion and with the plate-like member free to vibrate in response to being magnetically biased by the second magnetic biasing means. The first magnetic biasing means is comprised of a permanent magnet within the waterproof housing and attracting the magnetic portion of the plate-like member for holding the plate-like member in the rest position and resting on the shoulder of the side of the waterproof housing which is made of non-conductive material. The second magnetic biasing means is comprised of an electromagnet responsive to electrical signals applied thereto for developing a magnetic field effective to bias the magnetic portion of the plate-like member to oscillate the plate-like member.

DESCRIPTION OF THE PREFERRED EMBODIMENT

Figure 1:
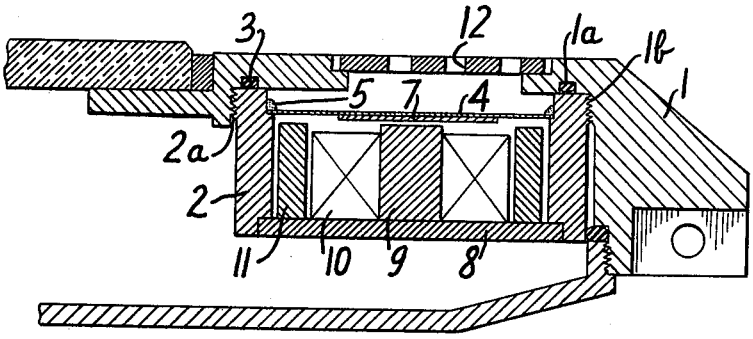
FIG. 1 (PRIOR ART)
FIG. 1 is a sectional view of a main part of a conventional watch with an electronic buzzer.

The conventional waterproof electronic watch with an electronic buzzer, as shown in FIG. 1 comprises a facing case 1, a supporting member 2 which constitutes a part of the electronic buzzer and a packing 3 inserted therebetween. The packing 3 is pressed by the supporting member 2 and the facing case 1 is engaged with the supporting body member 2 whereby the water-proof condition of an internal portion of the watch is maintained. The inner portion of the electronic buzzer is kept water-proof by bonding an oscillating plate 4 made of thin metal to an entire periphery of a shoulder portion at the inside of the supporting member 2 through an additive 5.

However, since in such structure, the oscillating plate 4 is secured through the additive 5, the structure of the watch can not endure water pressure of about four atmospheric pressure. Accordingly, the waterproof structure can not be incorporated in the watch with an electronic buzzer. The oscillating plate may be separated from the supporting member 2 because of ageing of the additive. Normal operation of the electronic buzzer cannot be guaranteed for a long time.

In order to remove the above-mentioned drawbacks, the present invention provides a watch with an electronic buzzer of high reliability so as to keep and enable a water-proof structure by placing a non-conductive material between an oscillating plate and the oscillating plate driving member, and to actuate the electronic buzzer for a long time.

Figure 2:
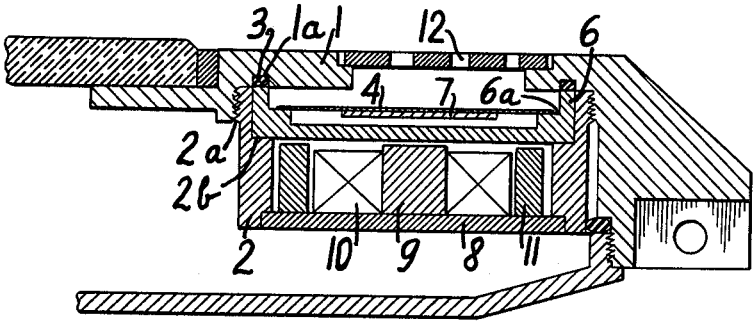
FIG. 2 is a sectional view of a main part of the watch with the electronic buzzer according to the present invention.

Referring to FIG. 2, the present invention will be explained in detail. FIG. 2 is a sectional view of a watch with an electronic buzzer of the present invention. 1 is a facing case and is provided with a recessed portion 1*a* on which a packing 3 is placed and a thread portion 1*b*. 2 is a supporting member constituting an electronic buzzer unit. The supporting member has a thred portion 2*a* engaging with the thread portion 1*b* of the facing case 1 and a shoulder portion 2*b* on which a non-conductive material 6 is placed. The non-conductive material 6 is provided with a shoulder 6*a* on which the oscillating plate 4 is placed. To the oscillating plate 4, a plate 7 made of soft magnetic material is attached. This plate 7 applies bias force magnetically between the electronic buzzer driving members. 8 is a plate made of soft magnetic material and is secured to the supporting member and has a magnetic core 9 composed of soft magnetic material. 10 is a coil wound around the magnetic core 9. 11 is a ring-like or ring-shape magnet arranged outside of the coil.

A magnetic loop or magnetic circuit is defined by the plate 7, the magnet 11, the plate 8, the magnetic core 9 and the non-conductive material 6. When electric current flows through the coil, a magnetic actuating force is applied to the plate 7, the oscillating plate 4 generates acoustic waves of audio frequency and the acoustic waves reaches the users through sound radiation openings 12. When assembling the afore-described structure of the invention, at first the packing 3 is mounted on the recessed portion 1*a* of the facing case 1. The packing 3 is pressed by the non-conductive material 6. The packing is compressed by engaging a thread portion 1*b* of the facing case 1 with the thread portion 2*a* of the supporting member so as to maintain the water-proof condition.

As mentioned above, the watch with an electronic buzzer according to the present invention maintains its water-proof condition by placing the nonconductive material between the oscillating plate and the oscillating plate driving member to oscillate the oscillating plate. Therefore, the watch of the invention can completely endure the water pressure of about four atmospheric pressure. Since an additive is not used, the normal operation of the electronic buzzer can be guaranteed and an inexpensive and highly reliable watch can be provided.

I claim:

1. In a timepiece, a waterproof acoustic vibrator comprising: a waterproof housing having a side made of nonconductive material; a plate-like member having a magnetic portion and mounted for oscillation outside and opposite the non-conductive side of said waterproof housing; first magnetic biasing means for magnetically biasing said plate-like member to maintain the same in a rest position when said plate-like member is not oscillating; and second magnetic biasing means within said waterproof housing for magnetically biasing said plate-like member to oscillate and develop audible acoustic waves.

2. In a timepiece, a waterproof acoustic vibrator according to claim 1, wherein said side of said waterproof housing made of non-conductive material includes a shoulder portion raised above said side and dimensioned for supporting said plate-like member with a peripheral portion of said plate-like member resting on said shoulder portion and with said plate-like member free to vibrate in response to being magnetically biased by said second magnetic biasing means.

3. In a timepiece, a waterproof acoustic vibrator according to claim 1, wherein said first magnetic biasing means is comprised of a permanent magnet within said waterproof housing and attracting the magnetic portion of said plate-like member for holding said plate-like member in the rest position.

4. In a timepiece, a waterproof acoustic vibrator according to claim 1, wherein said second magnetic biasing means is comprised of an electromagnet responsive to electrical signals applied thereto for developing a magnetic field effective to bias the magnetic portion of said plate-like member to oscillate said plate-like member.

5. A watch having a watch case with openings therethrough for emitting audible acoustic waves therethrough, a plate mounted for oscillator within said watch case for generating audible acoustic waves, driving means for driving said plate to oscillate, and a non-conductive platelike member disposed within said watch case between said plate and said driving means and defining a moistureproof barrier for preventing moisture from reaching said driving means through the openings through said watch case.

6. A watch according to claim 5 wherein said non-conductive platelike member has a periphery, wherein said non-conductive platelike member is fixed along its periphery to said watch case and is positioned to completely underlie the openings through said watch case, and the watch further including moistureproof packing material between the periphery of said non-conductive platelike member and said watch case defining a moistureproof seal for preventing moisture from entering said watch case through the openings therethrough and going beyond the moistureproof barrier defined by said non-conductive platelike member and into the remainder of said watch case.

* * * * *